US006854374B1

(12) United States Patent
Breazeale

(10) Patent No.: US 6,854,374 B1
(45) Date of Patent: Feb. 15, 2005

(54) EXPLOSION CONTAINMENT NET

(76) Inventor: O. Alan Breazeale, 8307 County Rd., 6920, Lubbock, TX (US) 79407

( * ) Notice: Subject to any disclaimer, the term of this patent is extended or adjusted under 35 U.S.C. 154(b) by 0 days.

(21) Appl. No.: 10/638,505

(22) Filed: Aug. 12, 2003

(51) Int. Cl.[7] ..... F42B 33/06; F42B 12/34; F42B 12/36

(52) U.S. Cl. ..... 86/50; 102/502; 102/504

(58) Field of Search ..... 86/50; 102/502, 102/504

(56) References Cited

U.S. PATENT DOCUMENTS 2,631,977 A * 3/1953 Allen ..... 252/7
3,648,613 A * 3/1972 Cunn ..... 102/303
3,801,416 A * 4/1974 Gulbierz ..... 109/49.5
3,814,016 A * 6/1974 Leach et al. ..... 102/303
4,589,341 A * 5/1986 Clark et al. ..... 102/303
5,076,168 A * 12/1991 Yoshida et al. ..... 102/303
5,750,918 A * 5/1998 Mangolds et al. ..... 102/502
5,864,767 A * 1/1999 Drumgoole et al. ..... 588/202
6,289,816 B1 * 9/2001 Keenan et al. ..... 102/303
6,405,626 B1 * 6/2002 Bureaux et al. ..... 86/50
6,439,120 B1 * 8/2002 Bureaux et al. ..... 102/303

* cited by examiner

*Primary Examiner*—Teri P. Luu
*Assistant Examiner*—Bret Hayes
(74) *Attorney, Agent, or Firm*—Peter Loffler

(57) ABSTRACT

A net is made from an explosive resistant material such as KEVLAR and is thrown over an explosive-laden device such that the net helps contain the blast force of the explosive-laden device. The net also has a nozzle that is fluid connected to a fire suppressant agent as well as a high density foam, each of which are discharged through the nozzle once the net is thrown over the explosive-laden device, the fire suppressant agent and the high density foam each helping to minimize the blast force of the explosive-laden device. The net can be thrown manually or can be fired from a gun that uses either pneumatic force or a firing cartridge to propel the net at its target.

9 Claims, 4 Drawing Sheets

EXPLOSION CONTAINMENT NET

BACKGROUND OF THE INVENTION

1. Field of the Invention

The present invention relates to a net that is draped over an bomb-laden person, which net helps minimize the explosive force of the detonated bomb, as well as helps contain the explosive force that results from a detonation of the bomb.

2. Background of the Prior Art

Many young fanatics strap several pounds of explosives about their bodies, go to a crowded gathering spot, and detonate the explosives, killing and maiming many people gathered in the crowd. While such homicide bombings are quite perplexing to those of sound mind and rational thought, they are nevertheless, one of the tools of modern day terrorists and a sobering reminder of the times we live in.

Steps are being taken to minimize these homicide bombings, the chief among them is to identify the homicide bomber and isolate the bomber before he or she can get amongst a large crowd of innocent targets. Once identified, the would-be homicide bomber is either forcibly escorted away from the crowd or killed in his tracks in order to avoid unnecessary death and injury.

While such steps tend to be effective in preventing wide spread death and injury, such steps are not without drawbacks. In order to usher the homicide bomber away from a crowd, one or more security personnel (or brave good Samaritans) are typically used to physically prevent the homicide bomber from reaching the desired target area. Such security personal tend to have the physical strength to accomplish this task, however, the homicide bomber, knowing that the main target has been foiled, detonates the explosives strapped about the bomber, killing or injuring the security personal that is ushering the bomber away from a crowded civilian area. Although the loss of life tends to be less than would be occasioned if the homicide bomber reaches the intended target, the loss of the brave security personal is still unacceptable.

Another method commonly used to minimize the loss of life and limb in the event of a homicide bomber is simply to shoot the bomber once identified. Typically, the shot is aimed at the torso of the bomber, whereat the explosives are strapped, in order to detonate the explosives and thereby stop the bomber dead in his tracks. This method, while also generally effective has a threefold problem. In the first place, many homicide bombers are identified upon reaching the periphery of the target area. Such locations tends to be other than thinly occupied and if the shot at the bomber misses, an innocent bystander may be struck. Additionally, the explosive pack about the bomber may cause injury to those in the vicinity of the bomber. Again, while such diffusion of the homicide bomber is preferred over the prospect of the bomber exploding the bomb belt in the thick of a crowd, the death or injury of anyone other than the homicide bomber is undesired and must be minimized. Another problem with this method is that if the alleged homicide bomber is inadvertently misidentified, an innocent person could be shot.

Ideally, a system needs to be established that allows security personal, upon the identification of a potential homicide bomber, to be able to contain the homicide bomber, and if the homicide bomber explodes the bomb pack strapped about the bomber, to be able to minimize and contain the explosive blast. Such a system needs to be of relatively simple and straightforward construction and must have relatively simple operational deployment. Such a system must minimize the potential for injury to innocent bystanders, and must prevent serious injury or death to a person who is misidentified as a homicide bomber.

SUMMARY OF THE INVENTION

The explosion containment net of the present invention addresses the aforementioned needs in the art. Specifically, the explosion containment net allows security personal, upon the identification of a potential homicide bomber, to be able to contain a homicide bomber in his or her tracks, and if the homicide bomber explodes the bomb pack strapped about the bomber, the security personnel are able to minimize and contain the explosive blast, thereby greatly reducing death and injury to innocent bystanders. The explosion containment net is relatively simple and straightforward construction and operational deployment of the system is relatively simple and easy. The explosion containment net minimize helps prevent serious injury or death to a person who is misidentified as a homicide bomber in the event that the explosion containment net is deployed upon an innocent person.

The explosion containment net of the present invention is comprised of a net manufactured from an explosion containment material, such as aramid (sold under the trademark KEVLAR and manufactured by the E.I. Du Pont de Nemours and Company), the net having an outer periphery and a nozzle. A gun is provided that is capable of propelling the net at a desired target such as an explosive-laden device. A first tank has fire suppressant agent therein while a conduit extends between the first tank and the nozzle. The gun propels the net at the explosive-laden device and the fire suppressant agent is discharged out through the nozzle once the gun propels the net. The net contains the explosive force from the explosive-laden device and the fire suppressant agent minimizes the explosive force. A second tank is provided and has a high density foam therein such that the conduit also extends between this second tank and the nozzle and the high density foam is also discharged once the gun propels the net and the high density foam also helps minimize the explosive force of the explosive-laden device. The nozzle may be located at a central point of the net while a plurality of pleats extend radially outwardly from the central point of the net, the pleats being stitched together. At least one weight is located about the outer periphery of the net. The gun may use either pneumatic force or a firing cartridge to propel the net. The fire suppressant agent may be FE-36 clean agent fire extinguishant or may be selected from the group consisting of: Halon 1211, Halon 1301, IG-541, HFC-227ea, HFC-2 (FE13), HCFC Blend A, Carbon Dioxide, high expansion foam, protein foam, AFFF, microbial containing foam, Carbon Tetrachloride, dry powder extinguishant, and wet chemical extinguishant.

BRIEF DESCRIPTION OF THE DRAWINGS

Similar reference numerals refer to similar parts throughout the several views of the drawings.

DESCRIPTION OF THE PREFERRED EMBODIMENT

Figure 1:
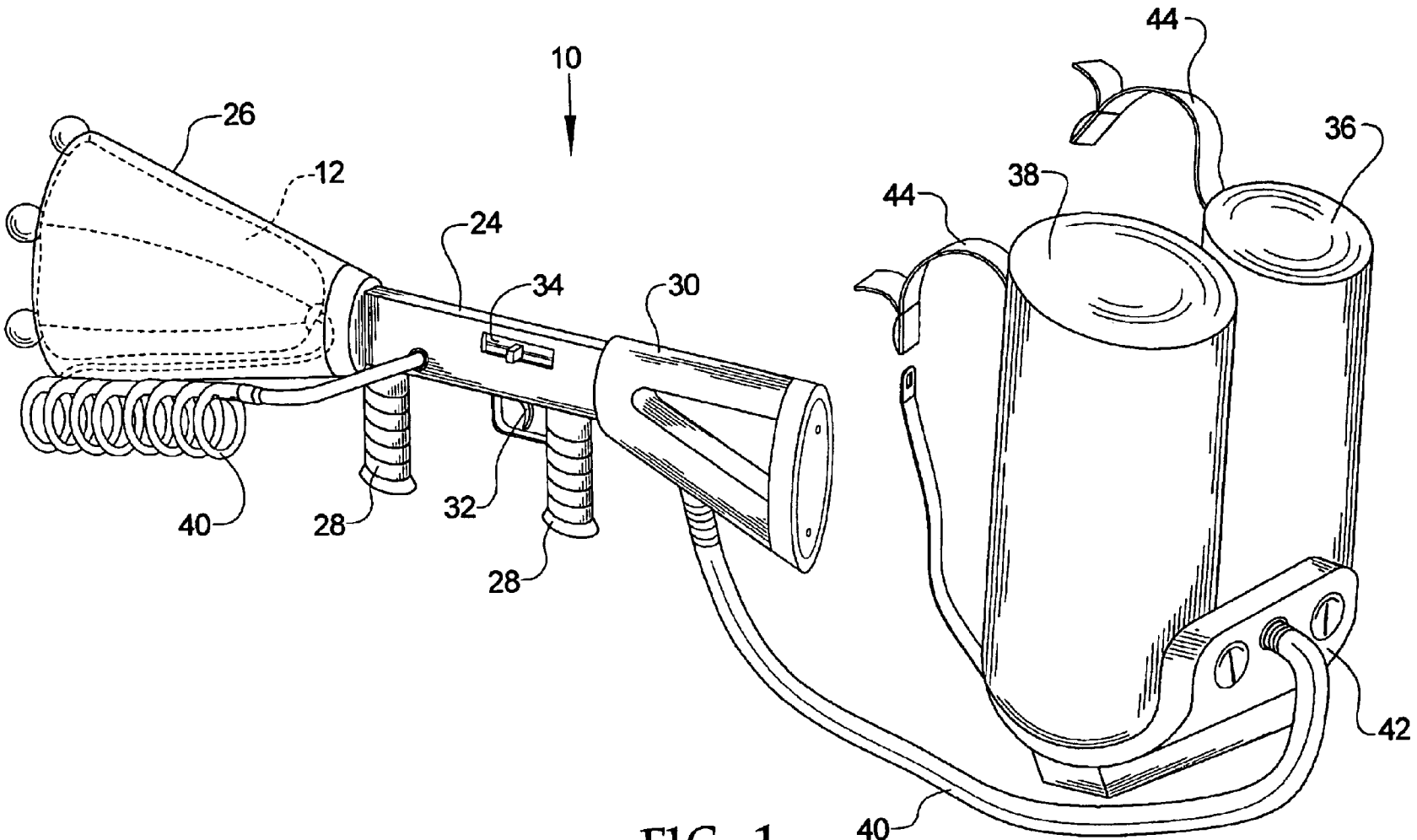
FIG. 1 is a perspective view of the explosion containment net of the present invention.
Figure 2:
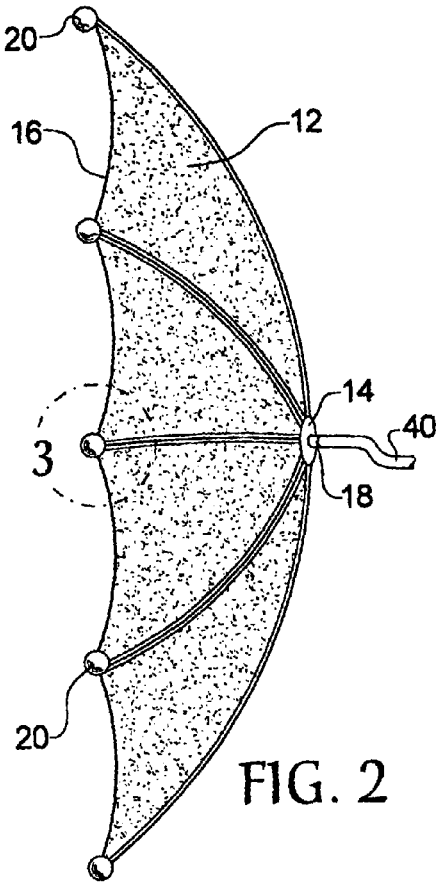
FIG. 2 is an elevation view of the net of the explosion containment system with the pleats in a non-expanded state.
Figure 3:
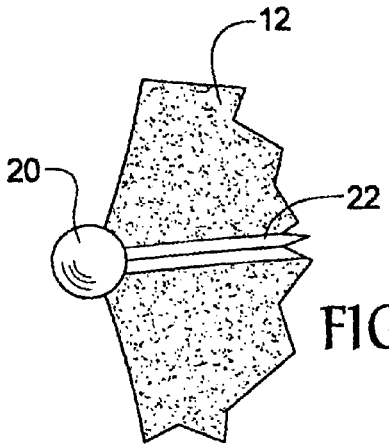
FIG. 3 is a close-up view of detail 3 in FIG. 2 with the pleats in a non-expanded state.
Figure 4:
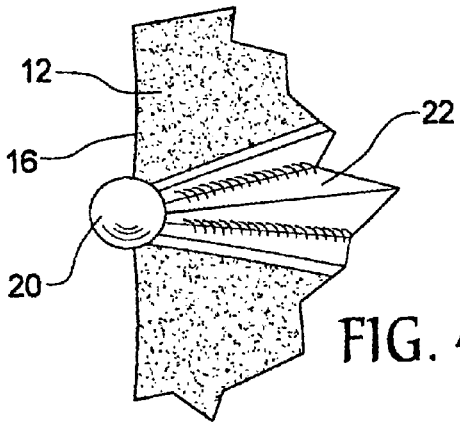
FIG. 4 is a close-up view of the pleats in an expanded state.
Figure 5:
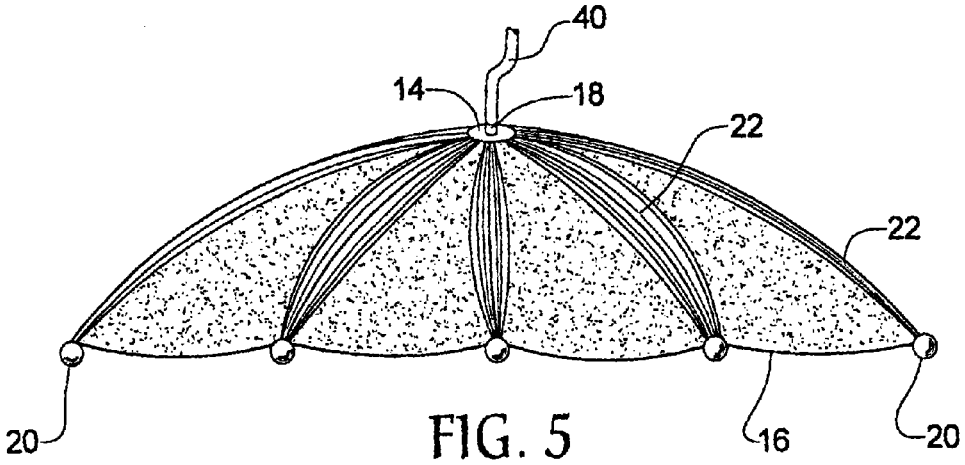
FIG. 5 is an elevation view of the net of the explosion containment system with the pleats in an expanded state.
Figure 6:
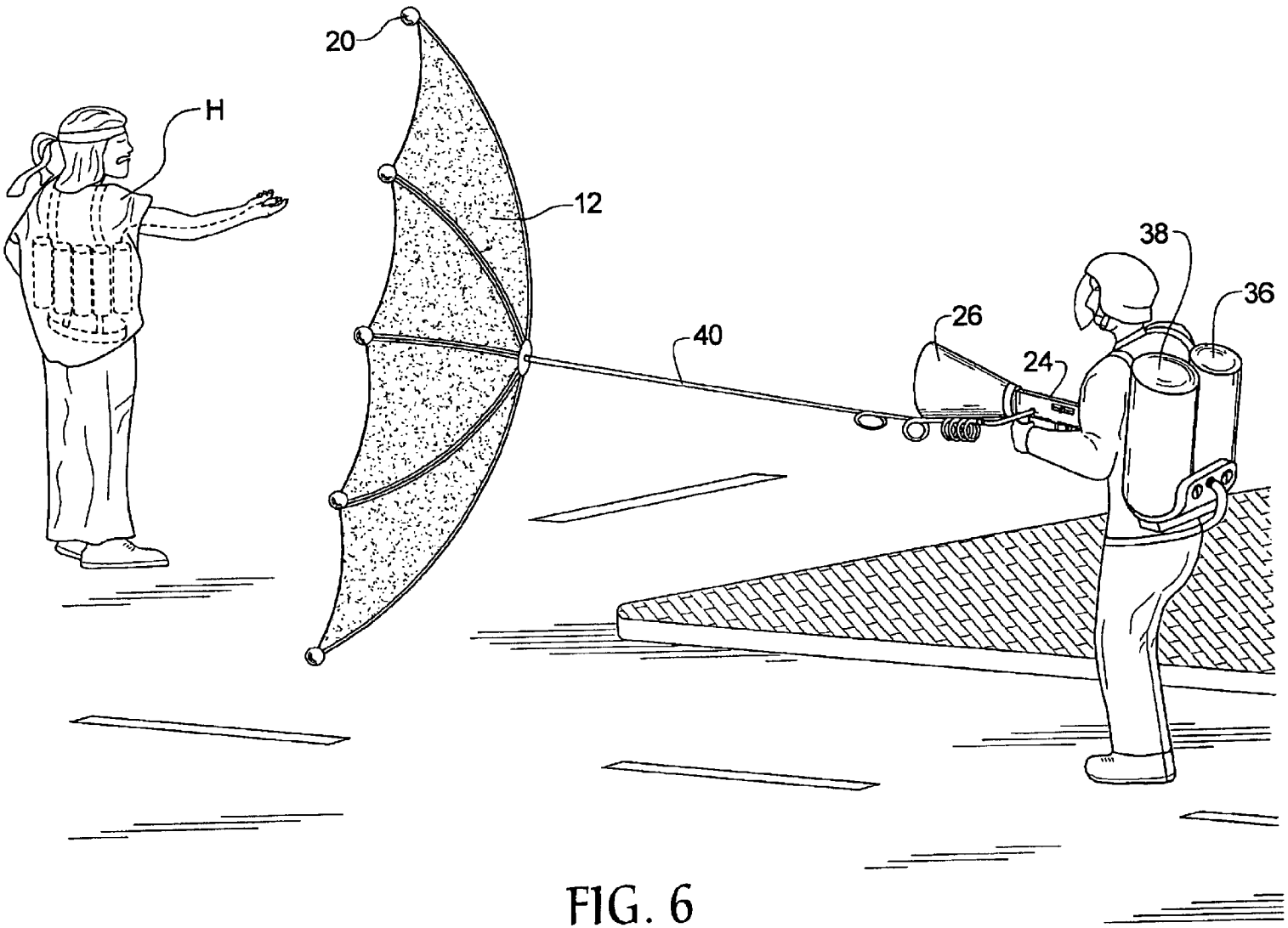
FIG. 6 is an environmental view of the explosion containment system being fired at a homicide bomber.
Figure 7:
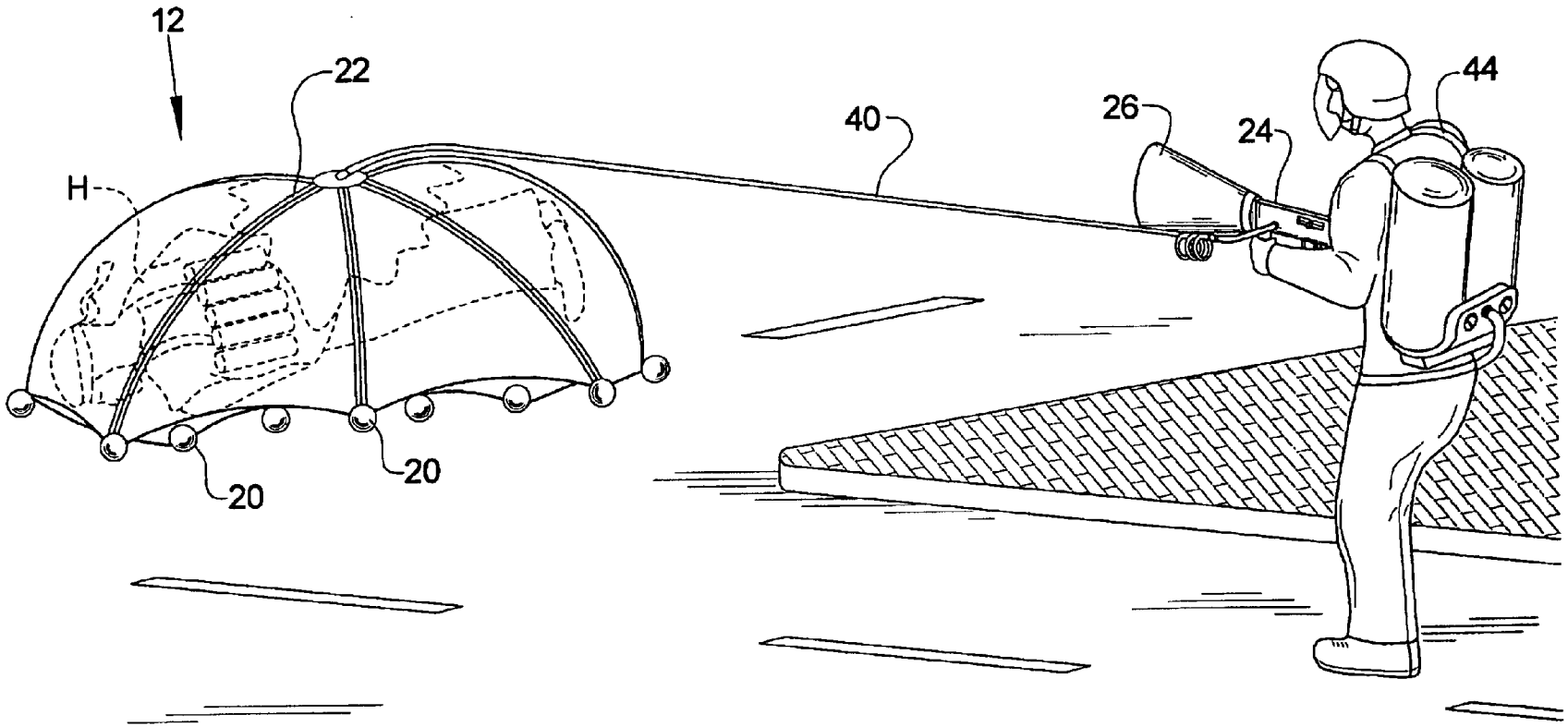
FIG. 7 is an environmental view of the explosion containment system containing the homicide bomber.

Referring now to the drawings, it is seen that the explosion containment net of the present invention, generally denoted by reference numeral 10, is comprised of a net 12 which may be generally round in shape and have a central point 14 and an outer periphery 16. The net 12 is manufactured from an explosion containment material, which material has a high tensile strength. Once such material that is well suited for this application is aramid yarn (sold under the trademark KEVLAR and manufactured by the E.I. Du Pont de Nemours and Company), which is an organic yarn within the family of aromatic polyamides. KEVLAR has a unique combination of high strength, high modulus, toughness, and thermal stability. Some specific properties of KEVLAR are that it has a breaking tenacity of 22.0 grams/denier (194.2 cN/tex) which is more than five times as strong as steel wire and twice as strong as industrial yarns of nylon, polyester or fiberglass as used in mechanical rubber goods. KEVLAR has a high initial modulus of 525 grams/denier (4636 cN/tex), which is about twice the modulus of steel wire, four times the modulus of high tenacity polyester and nine times the modulus of high tenacity nylon. KEVLAR has an excellent thermal stability (retains 84% of its strength after 48 hours in dry air at 350 degrees. Although KEVLAR is an ideal candidate for the net 12, any appropriate material that has high strength and flexibility, such as graphite and boron reinforced fibers, etc., can be used to manufacture the net 12.

A nozzle 18 is located on the net 12 and may be located at the central point 14, while a series of weights 20 can be located about the outer periphery 16 of the net. A series of pleats 22 may be located on the net 12 and may extend radially outwardly from the central point 14 of the net 12, each pleat 22 is sewn together using an appropriate high strength thread, which may also be made from KEVLAR and the stitching used to sew the pleats together is spaced very close together.

A gun 24 is provided and has a cone loader 26, appropriate hand grips 28, a butt stock 30 (if desired) and a trigger 32. The gun may be pneumatically fired wherein a source of high pressure gas (not illustrated) provides the pneumatic force to fire the gun 24. This high pressure gas source may be either an external or internal canister or may be a small cartridge that is fed into the gun through the gun's chamber 34. Alternately, the gun 24 may be fired by a firing cartridge such as a standard firing blank.

A first tank 36 is provided and holds a fire suppressant agent therein, the fire suppressant agent being either FE-36 clean agent fire extinguishant or being selected from the group consisting of: Halon 1211, Halon 1301, IG-541, HFC-227ea, HFC-2 (FE13), HCFC Blend A, Carbon Dioxide, high expansion foam, protein foam, AFFF, microbial containing foam, Carbon Tetrachloride, dry powder extinguishant, and wet chemical extinguishant. A second tank 38 is provided and has a high density or high expansion foam therein. The first tank 36 and the second tank 38 are fluid flow connected with the nozzle 18 on the net 12 via a conduit 40 which passes through the gun 24 so that the trigger 32 on the gun can control discharge of the contents of the two tanks 36 and 38. The two tanks 36 and 38 pass through a manifold 42 prior to entering the conduit 40. A section of the conduit 40 (the section that is disposed between the gun 24 and the nozzle 18) may be coiled for compactness of design. Carrying straps 44 may be provided for ease of carrying of the two tanks 36 and 38.

In order to use the explosion containment net 10 of the present invention, the net 12 is folded appropriately and placed into the cone loader 26 of the gun 24 and the gun 24 is appropriately primed (either a firing cartridge is inserted into the firing chamber 32 or a supply of pressurized gas is provided for the gun). Once the user identifies an appropriate target, such as a homicide bomber H or an explosive-laden container, etc., the user squeezes the trigger 32 in order to fire the gun 24 which propels the net 12 at the target in order to drape the net 12 over the target. The weights 20 along the outer periphery of the net 12 help the net land appropriate about the target in order to effectively cover the target. Continued squeezing of the trigger 32 causes the high density foam and the fire suppressant agent to be discharged through the nozzle 18 onto the target being covered by the net 12. If the target explodes, the net 12 helps absorb and otherwise contain the explosive blast created, while the high density foam also helps contain the explosive blast and the fire suppressant agent, helping to rob the explosion of oxygen, helps minimize the explosive force. As the blast occurs, the pleats 22 on the net 12 rip apart. As the stitching is a closely spaced high strength thread, the ripping apart of the pleats helps absorb some of the energy of the blast.

While the invention has been particularly shown and described with reference to an embodiment thereof, it will be appreciated by those skilled in the art that various changes in form and detail may be made without departing from the spirit and scope of the invention.

I claim:

1. A system capable of minimizing an explosive force of an explosive-laden device, the system comprising:

a net manufactured from an explosion containment material, the net having an outer periphery, a central point and a nozzle located at the central point;

a gun capable of propelling the net;

a first tank having a fire suppressant agent therein;

a conduit extending between the first tank and the nozzle via the gun; and wherein the gun propels the net at the explosive-laden device and the fire suppressant agent is discharged out through the nozzle under control of the gun once the gun propels the net, and such that the net acts as a containment system that contains the explosive force from the explosive-laden device and the fire suppressant agent minimizes the explosive force.

2. The system as in claim 1 further comprising a second tank having a high density foam such that the conduit also extends between the second tank and the nozzle and the high density foam is also discharged once the gun propels the net and the high density foam helps contain the explosive force of the explosive-laden device.

3. The system as in claim 1 wherein the net has a plurality of pleats that are stitched together, each of the plurality of pleats radiating from proximate the central point toward the outer periphery such that each of the plurality of pleats is designed to tear apart upon the net acting to contain the explosive force from the explosive-laden device.

4. The system as in claim 1 further comprising at least one weight located about the outer periphery of the net.

5. The system as in claim 1 wherein the gun uses pneumatic force to throw the net.

6. The system as in claim 1 wherein the gun uses a firing cartridge to throw the net.

7. The system as in claim 1 wherein the fire suppressant agent is FE-36 clean agent fire extinguishant.

8. The system as in claim 1 wherein the fire suppressant agent is selected from the group consisting of: Halon 1211, Halon 1301, IG-541, HFC-227ea, HFC-2 (FE13), HCFC Blend A, Carbon Dioxide, high expansion foam, protein foam, AFFF, microbial containing foam, Carbon Tetrachloride, dry powder extinguishant, and wet chemical extinguishant.

9. The system as in claim 1 wherein the net is made from aramid.

* * * * *